US006129414A

United States Patent [19]

Brevi

[11] Patent Number: 6,129,414

[45] Date of Patent: Oct. 10, 2000

[54] ARTICULATION FOR A FOLDING FRAME

[75] Inventor: Mauro Brevi, Bergamo, Italy

[73] Assignee: Brevi S.r.l., Telgate, Italy

[21] Appl. No.: 09/122,696

[22] Filed: Jul. 27, 1998

[30] Foreign Application Priority Data

Aug. 19, 1997 [IT] Italy ..... MI97A1947

[51] Int. Cl.[7] ..... A47C 4/00

[52] U.S. Cl. ..... 297/16.1

[58] Field of Search ..... 297/16.1, 46, 51, 297/16.2, 440.1, 452.18; 16/221, 223, 249, 352

[56] References Cited

U.S. PATENT DOCUMENTS 1,062,010 5/1913 Jacobson .
1,679,173 7/1928 Rastetter .
2,199,185 4/1940 Monasch .
2,920,687 1/1960 Hurley .
5,478,138 12/1995 Yu .
5,707,104 1/1998 Perego .

*Primary Examiner*—Milton Nelson, Jr.
*Attorney, Agent, or Firm*—Guido Modiano; Albert Josif

[57] ABSTRACT

An articulation for folding frames comprising a hollow internal support, which is adapted to support the ends of respective rods which are pivoted to the internal support in two spaced points, and a pair of bar-like elements, each being provided with a first end pivoted to a respective rod and a second end pivoted to a pivot; the pivot being slideable in a slot formed in the internal support and being fixed to an external support which is movable with respect to the internal support so as to define at least two positions: an open position, in which the rods form an angle with respect to each other, and a closed position, in which the rods are folded and substantially parallel.

6 Claims, 4 Drawing Sheets

ARTICULATION FOR A FOLDING FRAME

BACKGROUND OF THE INVENTION

The present invention relates to an articulation for a folding frame.

The articulation according to the present invention can be used advantageously for the supporting frame of a folding highchair for children.

The fundamental features of a folding structure are, generally speaking, easy opening and closure and safety in use.

The folding structure must essentially ensure perfect stability while allowing quick actuation. Another important characteristic is the low weight of the folding structure, since portability is usually required.

Few of the many embodiments of folding structures meet these requirements, and these few are in any case susceptible of improvements, especially as regards safety in use and aesthetics.

SUMMARY OF THE INVENTION

The aim of the present invention is to provide an articulation for a folding frame which overcomes the drawbacks of the prior art.

An object of the invention is to provide an articulation which is safe in use.

A particular object of the invention is to provide an articulation which makes a supporting frame of a highchair safe to use, especially for children.

Another object of the invention is to provide an articulation which is constructively simple and reliable.

Another object of the invention is to provide an articulation which is aesthetically pleasant.

This aim, these objects and others which will become apparent hereinafter are achieved by an articulation for folding frames, characterized in that it comprises a hollow internal support, which is adapted to support the ends of respective rods which are pivoted to said internal support in two spaced points, and a pair of bar-like elements, each having a first end pivoted to a respective rod and a second end pivoted to a pivot; said pivot being slideable in a slot formed in said internal support and being fixed to an external support movable with respect to said internal support so as to set at least two positions: an open position, in which said rods form an angle between them, and a closed position, in which said rods are folded and substantially parallel.

BRIEF DESCRIPTION OF THE DRAWINGS

Further characteristics and advantages will become apparent from the description of a preferred but not exclusive embodiment of the invention, illustrated only by way of non-limitative example in the accompanying drawings, wherein.

DESCRIPTION OF THE PREFERRED EMBODIMENTS

Figure 1:
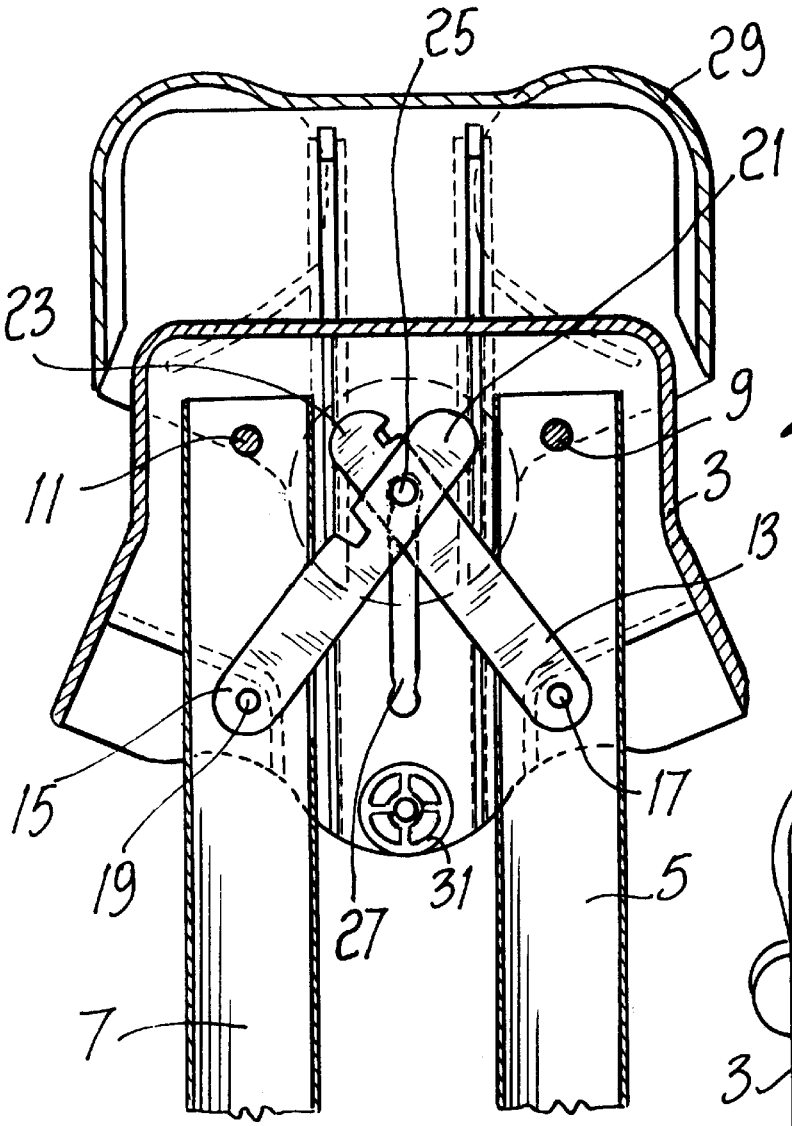
FIG. 1 is a sectional lateral elevation view of the articulation according to the invention, in the closed position.

With reference to the above figures, the articulation according to the invention, generally designated by the reference numeral 1, is shown as used, by way of example, in a folding frame 100 of a children's highchair 101.

The articulation according to the invention comprises a hollow internal support 3, which is adapted to support the ends of respective rods 5 and 7 pivoted to the internal support 3 in two spaced points by means of rivets, designated by the reference numerals 9 and 10 respectively.

Figure 8:
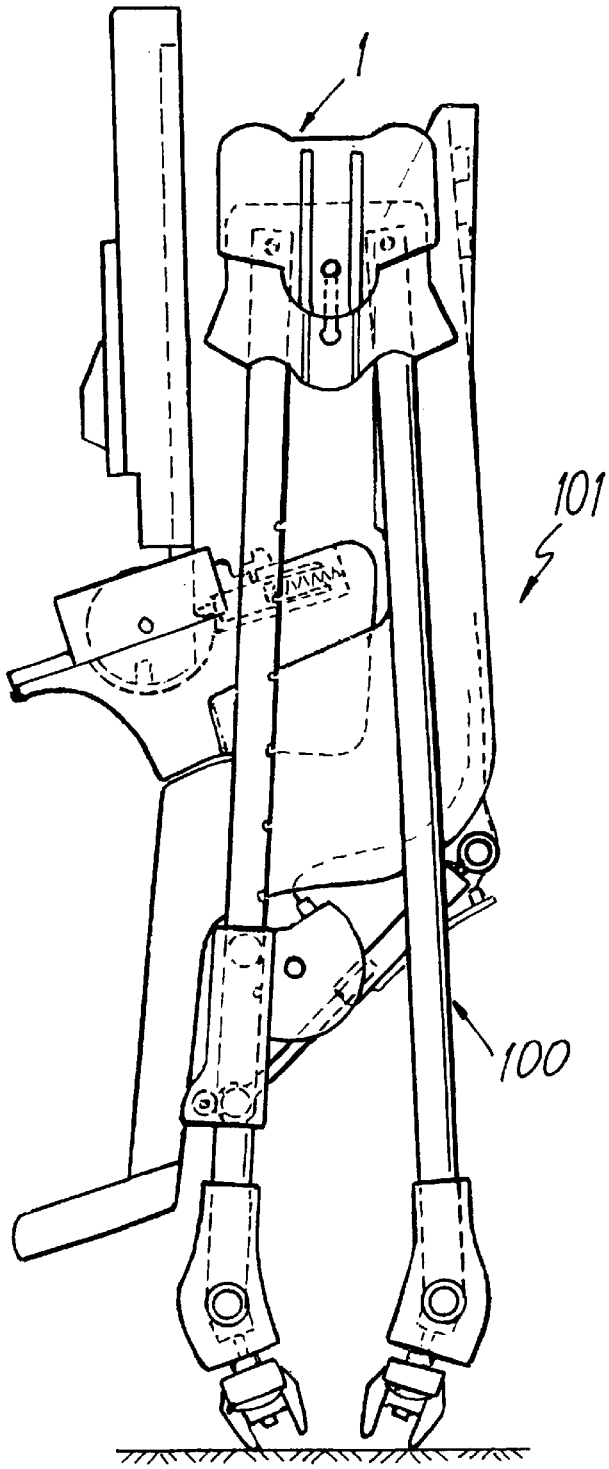
FIG. 8 is a partially sectional lateral elevation view of a highchair with folding frame, provided with the articulation according to the invention, in the closed or folded position.

Two bar-like elements, designated by the reference numerals 13 and 15 respectively, have a first end, designated by the reference numerals 17 and 19 a respectively, which is pivoted to the respective rod 5 and 7 and a second end, designated by the reference numerals 21 and 23 respectively, which is pivoted to a common pivot 25. The common pivot 25 is slideable in a slot 27 formed in the internal support 3 and is fixed to an external support 29, which can move with respect to the internal support 3, so as to define at least two positions: an open position (shown in FIGS. 4, 5, 6 and 7), in which the rods 5 and 7 are arranged at an angle to each other; and a closed position (shown in FIGS. 1, 2 and 8), in which the rods are folded and substantially parallel to each other.

The internal support 3 comprises a spacer 31 for strengthening the articulation, while the external support 29 is movable vertically, with reference to the case shown in the figures, so as to move the pivot into the two open and closed positions. In the closed position (FIG. 1), the pivot 25 is at the upper end of the slot 27 and the ends 17 and 19 of the bars 13 and 14 are closer to, and equidistant from, the slot 27. In the open position, the pivot 25 is at the lower end of the slot 27, in a position which lies below the point of intersection of the centerline of the slot 27 with a maximum line which connects the lower ends 17 and 19 of the bars 13 and 15, when said ends are furthest from the centerline, i.e., when the bars 13 and 15 are at right angles to the centerline. In this manner, as shown more clearly in FIG. 4, it is not possible to close the rods 5 and 9, i.e., to move them into the parallel position, because the ends 21 and 23 of the bars 13 and 15 are retained in their downward movement by the stroke limiter of the slot 27.

Figure 2:
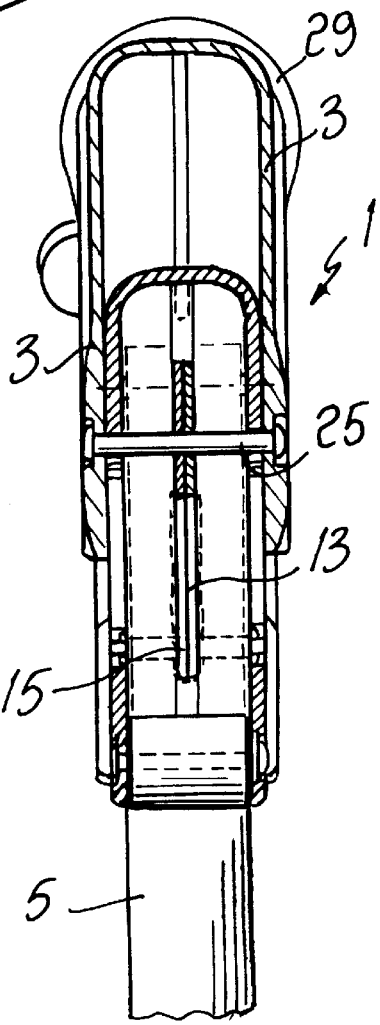
FIG. 2 is a sectional front elevation view of the articulation according to the invention, in the closed position.
Figure 3:
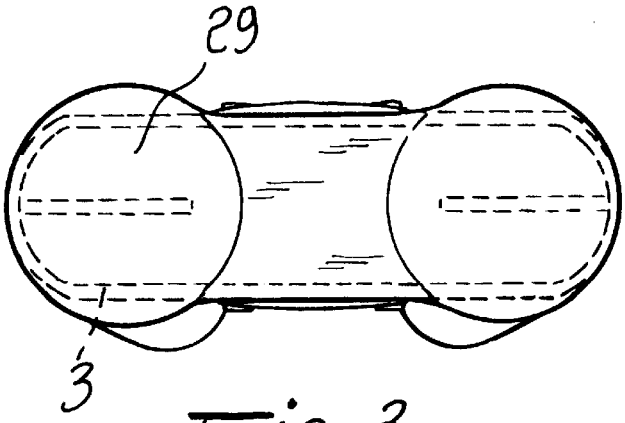
FIG. 3 is a plan view of the articulation of the preceding figures.
Figure 5:
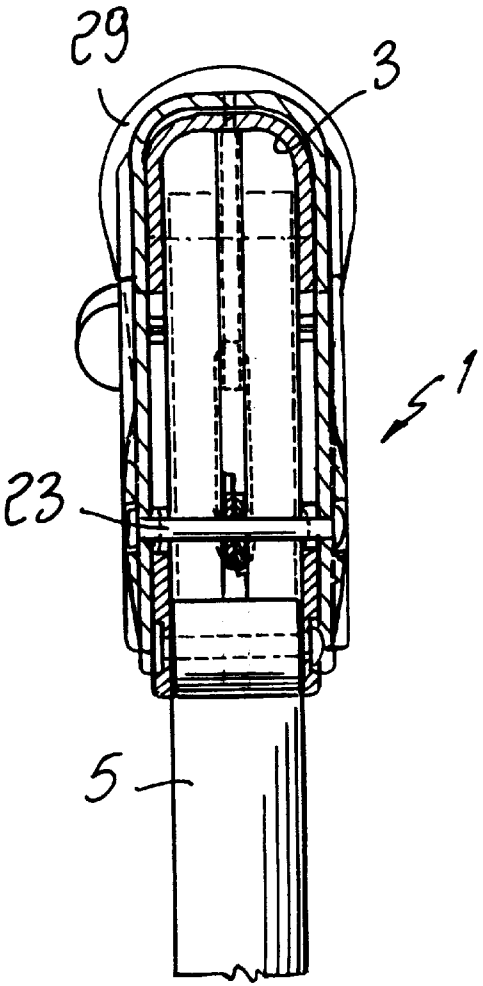
FIG. 5 is a sectional front elevation view of the articulation according to the invention, in the open position.
Figure 4:
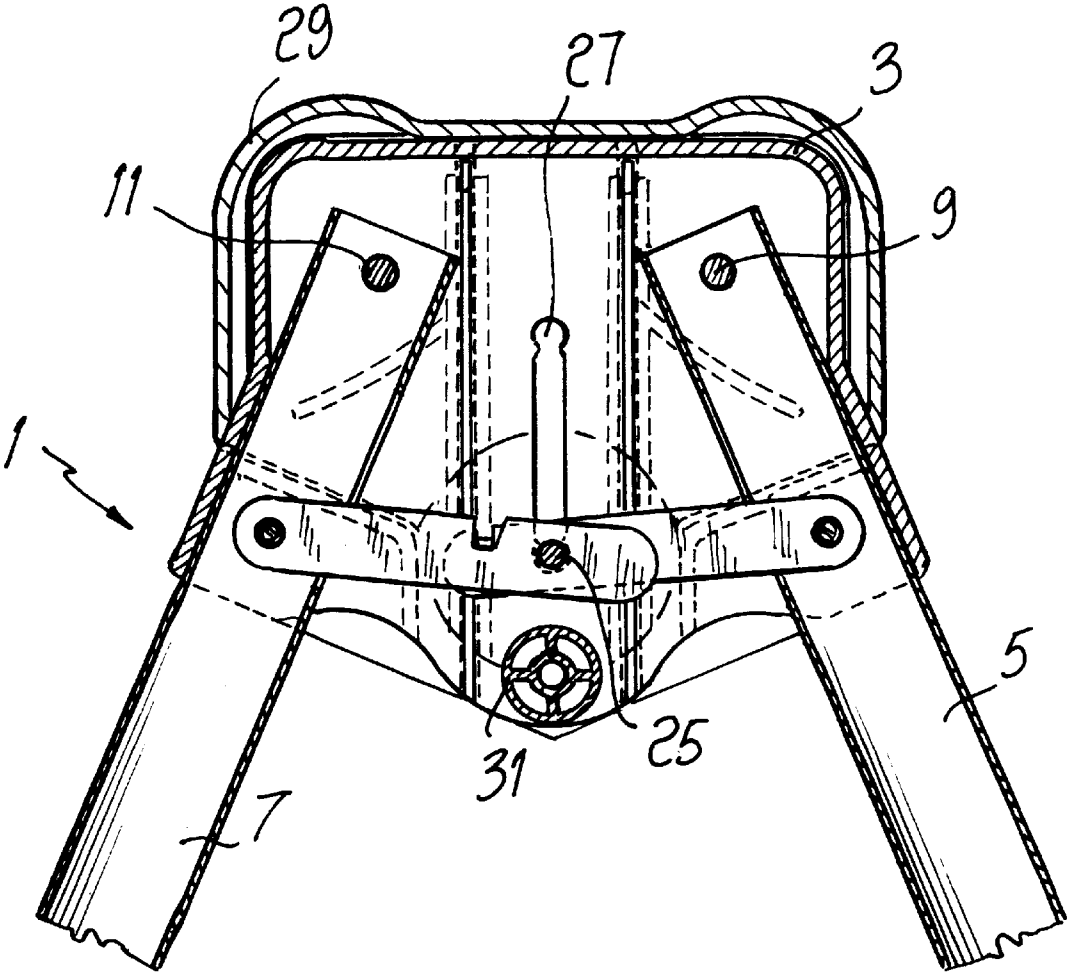
FIG. 4 is a sectional lateral elevation view of the articulation according to the invention, in the open position.
Figure 6:
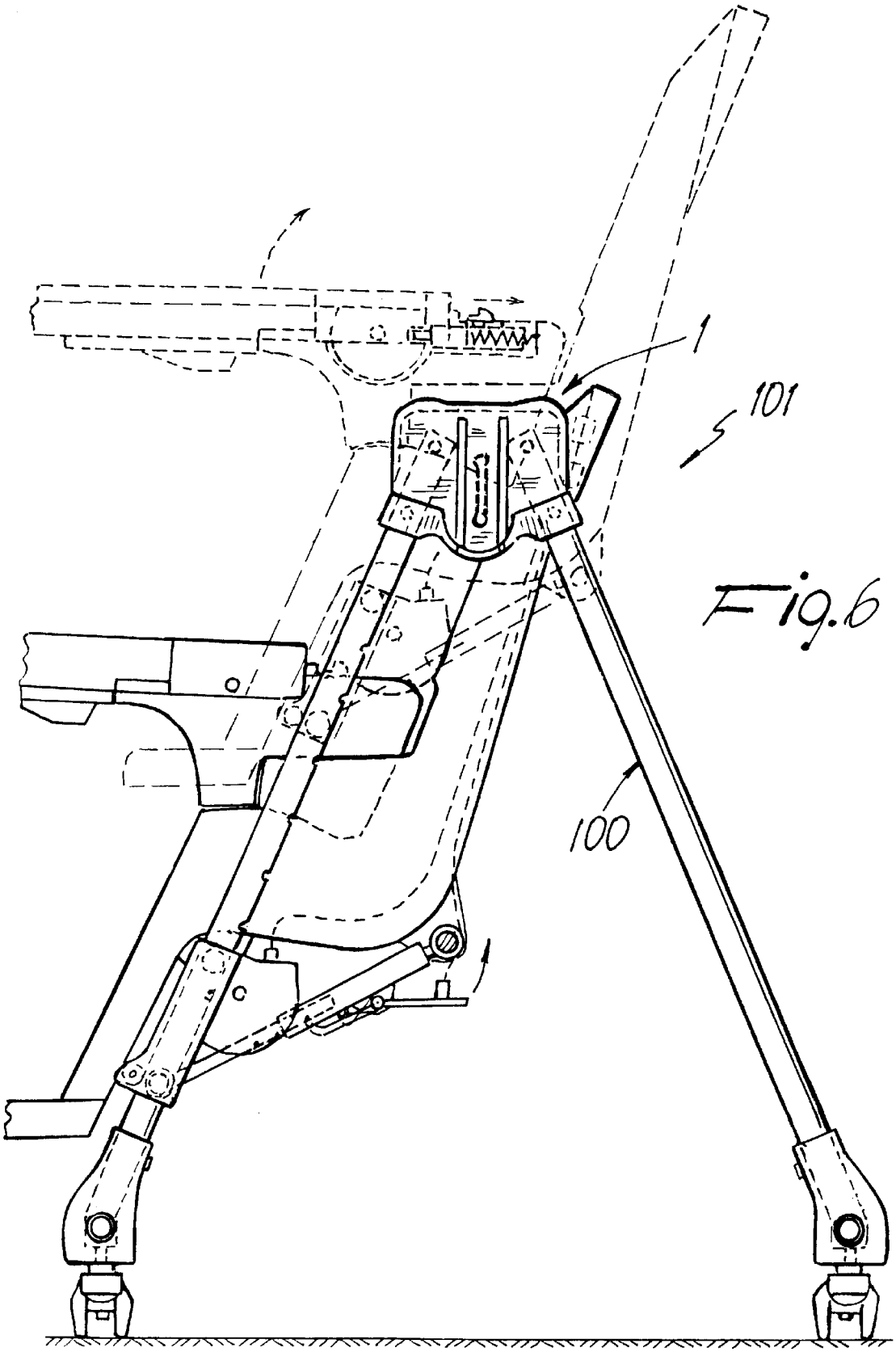
FIG. 6 is a partially sectional lateral elevation view of a highchair with a folding frame, provided with the articulation according to the invention, in the open position.
Figure 7:
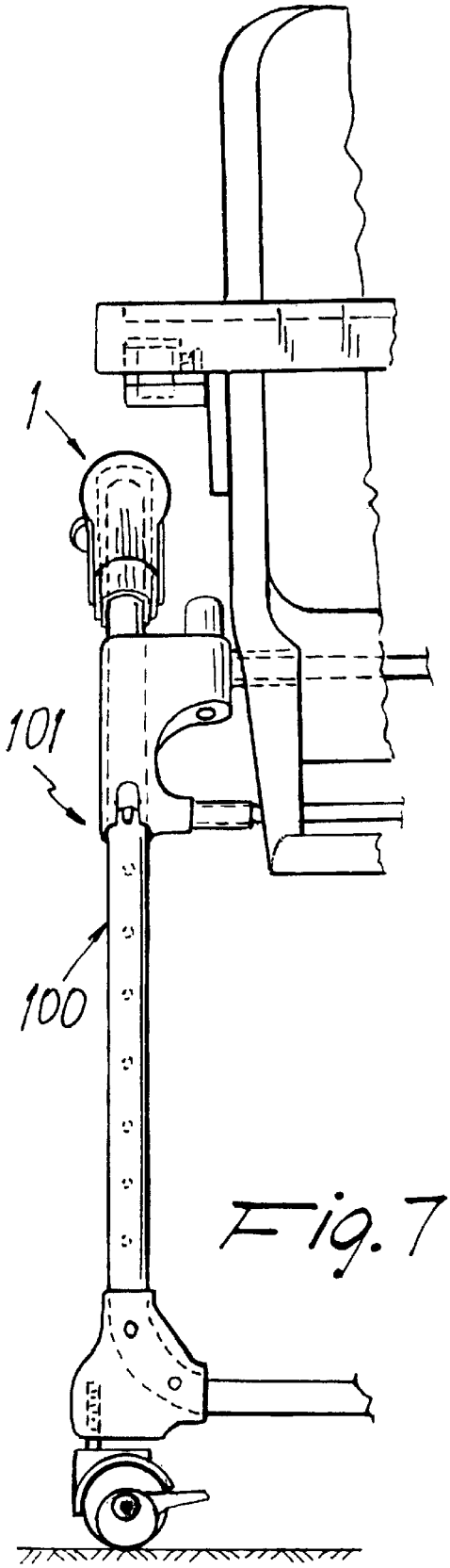
FIG. 7 is a partially sectional partial front elevation view of a highchair with folding frame, provided with the articulation according to the invention, in the open position.

Only by lifting the external support 29 is it possible to lift the pivot 25 beyond the maximum line, overcoming the elastic resistance of the support 3 and allowing the rods 5 and 7 to close, as shown in FIG. 1.

The operation of the articulation according to the invention is evident; it is in fact sufficient to act on the external support 29 so as to lift it, in order to close the rods 5 and 7 and therefore the frame 100, while in order to open the frame it is sufficient to open out the rods or legs 5 and 7, lowering the external support 29 until the pivot 25 reaches the lower stroke limiter of the slot 27, thus locking the frame 100 in the open position.

In practice it has been found that the invention achieves the intended aim and objects.

The articulation according to the invention is susceptible of numerous modifications and variations, all of which are within the scope of the inventive concept; all the details may furthermore be replaced with other technically equivalent elements.

The materials used, as well as the dimensions, may of course be any according to requirements and to the state of the art.

The disclosures in Italian Patent Application No. MI97A001947 from which this application claims priority are incorporated herein by reference.

What is claimed is:

1. An articulation for folding frames, comprising a hollow internal support, which is adapted to support ends of respective rods which are pivoted to said internal support in two spaced points, and a pair of bar elements, each having a first end pivoted to a respective rod of said rods and a second end pivoted to a pivot; said pivot being slideable in a slot formed in said internal support and being fixed to an external support which is movable with respect to said internal support so as to set at least two positions: an open position, in which said rods form an angle between them, and a closed position, in which said rods are folded and substantially parallel.

2. The articulation according to claim 1, wherein said external support is constituted by a box body which is open in a downward direction and is adapted to at least partially contain said internal support.

3. The articulation according to claim 1, wherein said internal support is constituted by a box body which is open in a downward direction and is adapted to contain said bar elements and the ends of said rods.

4. The articulation according to claim 1, wherein said internal support comprises inclined seats for said ends of said rods, which are adapted to lock said rods in an inclined position which corresponds to said open position.

5. A folding frame comprising at least one pair of rods which are pivoted in an articulation, wherein said articulation comprises a hollow internal support, which is adapted to support the ends of respective rods of said at least one pair of rods which are pivoted to said internal support at two spaced points, and a pair of bar elements, each being provided with a first end pivoted to a respective rod of said rods and a second end pivoted to a pivot; said pivot being slideable in a slot formed in said internal support and being fixed to an external support which is movable with respect to said internal support so as to define at least two positions; an open position, in which said rods form an angle with respect to each other, and a closed position, in which said rods are folded and substantially parallel.

6. An adjustable highchair for children, comprising two pairs of legs, each pair having two legs pivoted, in an upward region, to an articulation so that they can open in a caliper fashion, wherein said articulation comprises a hollow internal support, which is adapted to support ends of respective rods which are pivoted to said internal support at two spaced points, and a pair of bar elements, each being provided with a first end pivoted to a respective rod of said rods and a second end pivoted to a pivot; said pivot being slideable in a slot formed in said internal support and being fixed to an external support which is movable with respect to said internal support so as to define at least two positions: an open position, in which said rods form an angle with respect to each other, and a closed position, in which said rods are folded and substantially parallel.

* * * * *